US006299285B1

(12) United States Patent
Inui

(10) Patent No.: US 6,299,285 B1
(45) **Date of Patent: *Oct. 9, 2001**

(54) INK-JET PRINTING APPARATUS AND INK-JET PRINTING METHOD

(75) Inventor: Toshiharu Inui, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,566

(22) Filed: Feb. 17, 1998

(30) Foreign Application Priority Data

Feb. 17, 1997 (JP) ..... 9-031878

(51) Int. Cl.[7] ..... B41J 2/01
(52) U.S. Cl. ..... 347/43; 347/40; 347/15
(58) Field of Search ..... 347/41, 43, 40, 347/10, 56, 66, 47, 15

(56) References Cited

U.S. PATENT DOCUMENTS

| | | | |
|---|---|---|---|
| 4,313,124 | | 1/1982 | Hara . |
| 4,345,262 | | 8/1982 | Shirato et al. . |
| 4,459,600 | | 7/1984 | Sato et al. . |
| 4,463,359 | | 7/1984 | Ayata et al. . |
| 4,558,333 | | 12/1985 | Sugitani et al. . |
| 4,608,577 | | 8/1986 | Hori . |
| 4,723,129 | | 2/1988 | Endo et al. . |
| 4,740,796 | | 4/1988 | Endo et al. . |
| 5,455,610 | * | 10/1995 | Harrington ..... 347/43 |
| 5,570,118 | * | 10/1996 | Rezanka et al. ..... 347/43 |
| 5,708,463 | * | 1/1998 | Hirabayashi et al. ..... 347/43 |

FOREIGN PATENT DOCUMENTS

| | | |
|---|---|---|
| 54-56847 | 5/1979 | (JP) . |
| 56-84992 | 7/1981 | (JP) . |
| 59-123670 | 7/1984 | (JP) . |
| 59-138461 | 8/1984 | (JP) . |
| 60-71260 | 4/1985 | (JP) . |
| 64-63185 | 3/1989 | (JP) . |
| 3-146355 | 6/1991 | (JP) . |
| 4-158049 | 6/1992 | (JP) . |
| 4-332652 | 11/1992 | (JP) . |
| 7-195823 | 8/1995 | (JP) . |
| 8-39795 | 2/1996 | (JP) . |

* cited by examiner

*Primary Examiner*—N. Le
*Assistant Examiner*—Lamson Nguyen
(74) *Attorney, Agent, or Firm*—Fitzpatrick, Cella, Harper & Scinto

(57) ABSTRACT

An ink-jet printing apparatus which can print an image without causing bleeding or feathering with effectively using an ink and realize high quality image comparable with silver film photograph, and is convenient for use, can be provided. It enables printing in a first printing mode using a printing head unit ejecting yellow, magenta and cyan inks, respectively and a printing head unit ejecting a black ink and a printing quality improving liquid, and a second printing mode using the printing head unit ejecting yellow, magenta and cyan inks, respectively, and a printing head unit ejecting the black ink and cyan and magenta inks having lower density than that of the cyan and magenta ink.

16 Claims, 7 Drawing Sheets

INK-JET PRINTING APPARATUS AND INK-JET PRINTING METHOD

This application is based on Patent Application No. 31878/1997 filed Feb. 17, 1997 in Japan, the content of which is incorporated hereinto by reference.

BACKGROUND OF THE INVENTION

1. Field of the Invention

The present invention relates generally to an ink-jet printing apparatus and an ink-jet printing method performing printing by ejecting ink on a printing medium. More specifically, the invention relates to an ink-jet printing apparatus and an ink-jet printing method performing printing using ink, a liquid which can make a coloring agent in the ink insoluble or coagulated, or a plurality of inks having different densities. It should be noted that the present invention is applicable of all devices using printing media, such as paper, cloth, a non-woven fabric, an OHP sheet and so on, and more particularly to a business machine, such as a printer, a copy machine, a facsimile machine and the like, and manufacturing industrial machines, such as a textile printing apparatus and so on, as applicable apparatus.

2. Description of the Prior Art

Conventionally, an ink-jet printing apparatus performing printing for a printing medium, such as paper, cloth, a plastic sheet, an OHP sheet or the like (hereinafter simply referred to as printing paper) has various advantages, such as the capability of high-density and high-speed printing, and so on, and is widely employed as output means of an information processing system, such as a copy machine, a facsimile machine, an electronic typewriter, a wordprocessor, a printer as an output terminal of workstation and the like, or a handy printer or a portable printer to be provided in a personal computer, a host computer, an optical disk device, a video apparatus and so on.

In this case, an ink-jet printing apparatus has a construction adapted to a function, a mode of use and so on specific to each of these devices, respectively. Typically, the ink-jet printing apparatus includes a carriage mounting a printing head as printing means and an ink tank, transporting means for transporting the printing paper, and control means for controlling these components. The printing head which ejects ink droplets through a plurality of ejection openings, is scanned with respect to a printing paper in a direction (primary scanning direction) perpendicular to a transporting direction (auxiliary scanning direction) to perform ink ejection while scanning in the primary scanning direction. Also, the printing paper is intermittently transported in an amount corresponding to a printing width between each two scannings. This construction, in which printing is performed by ejecting ink on the printing paper, has been widely used as a printing system with a low running cost and low noise associating with printing. Further, by employing a printing head in which a large number of ejection openings for ejecting ink are arranged in alignment in the auxiliary scanning direction and by scanning the printing head on the printing paper, printing in a width corresponding to the number of ejection openings can be performed. By this arrangement, speeding up of the printing operation can be achieved.

In addition, in recent years, depending upon demand for full-color printing, there has been practiced an apparatus which mounts printing heads for three or four color inks, and is capable of forming a full color image. Such an apparatus mounts three or four kinds of printing heads and ink tanks for three primary colors of yellow (Y), magenta (M) and cyan (C) or four colors including black (hereinafter occasionally referred to as Bk) in addition to three primary colors.

In color printing by the conventional ink-jet printing system, it is generally known that the goals of preventing bleeding of the ink, and increasing the density of a black image and preventing feathering are inconsistent with each other. Therefore, in the conventional apparatus, it has been difficult to sufficiently satisfy the user's needs for quality of a color printing image. It has been known that this has been caused for following reasons.

Normally, in the case of performing color printing on a plane paper by an ink-jet printing method, bleeding of the ink in a boundary of respective color regions forming an image can be prevented by using an ink having a relatively high penetration speed, thus having high fixing ability. However, when using ink having high penetration speed, it is often the case that the density of the black image portion becomes low, and color development ability in color image portions other than black also becomes low. Furthermore, upon printing of a line image, typically represented by character or the like, it is possible to cause penetration of ink along fibers of the paper, thereby causing so-called feathering. In particular, in comparison with the image printed by a color other than black, feathering in the character printed by black ink is easily perceived to make the character vague for lack of sharpness. As set forth, as a result of the attempt to prevent bleeding between respective colors of inks, the quality of the overall printed image can be significantly lowered.

In contrast to this, it can be considered that the high density or the like of the image is realized while preventing feathering, by ejecting a large amount of the ink having relatively low penetration ability to the plane of the paper. However, in such case, for example, in the portions located adjacent the boundary of the black image and the color image, bleeding of the black ink and the color inks can be caused, to significantly lower the quality of the printed image.

As one system providing a solution for the foregoing problem, a system is known in which a heater is provided in a printing apparatus to promote evaporation of the ink and can obtain a color image having high-color-developing ability with no bleeding between the colors. However, such system may cause the apparatus to be bulky and have a high cost.

In Japanese Patent Application Laid-open No. 146,355/1991, there has been proposed a system in which printing is not performed for respective regions along the boundary between regions of the black and the color. However, this method requires varying the data for printing and thus it may happen that the quality of the image to be actually printed is degraded.

Also, in Japanese Patent Application Laid-open No. 158,049/1992, there is proposed a method of printing, in which printing heads corresponding to a plurality of colors for color printing and a printing head for character printing are provided, and printing is performed by switching use of the printing head for the color image and the printing head for character printing. In this method, when the black image printed by the color printing head and the black image printed by the character printing head are present in an admixing manner, an uncomfortable feeling may be caused due to a difference between the respective printing quality of the two modes.

Furthermore, there has been considered a method of preventing bleeding between the black ink and the color inks at the boundary between the black image and other color image by overlaying color inks in a black region along the boundary between the black and color images. As set forth above, the black can be obtained by overlaying three colors, Y, M, C (admixing of the colors). However, the black image obtained by overlaying the color inks tends to have a lower color-development ability in comparison with the normal black ink.

On the other hand, in Japanese Patent Application Laid-open No. 084,992/1981 and Japanese Patent Application Laid-open No. 063,185/1989, a technology employing a liquid which makes a dye in the ink insoluble is disclosed.

Japanese Patent Application Laid-open No. 084,992/1981, discloses a method, in which a material for fixing the dye is preliminarily applied on the printing paper. However, this method requires a special printing paper. Also, in order to preliminarily apply the material for fixing the dye, it is inherent to increase the size and a cost of the apparatus. Furthermore, it is relatively difficult to stably apply a predetermined layer thickness of the material on the printing paper.

Further, in Japanese Patent Application Laid-open No. 063,185/1989, there is disclosed a technology, in which a transparent ink, which makes dye insoluble, is deposited on the printing paper by means of an ink-jet printing head. By this method, since the dot diameter of the transparent ink is set greater than the dot diameter of the image printing ink, desired characteristics can be satisfied even when the deposition positions of the image printing ink and the transparent ink are shifted relative to each other. However, in this method, since the amount of the transparent ink to be deposited on the position corresponding to the image position is greater than that required, a longer fixing period becomes necessary and the image can be unclear.

Furthermore, in Japanese Patent Application Laid-open No. 195,823/1995, by applying a transparent precursor substance on a surface of the printing medium in advance of ink-jet printing, it enables color printing to be performed by one scan.

As set forth above, while the foregoing method disclosed in respective publications concerning the liquid which makes the dye insoluble, holds no critical drawbacks, respectively, it may be possible to prevent bleeding of ink between respective colors when the liquid making the dye in the ink insoluble is applied for color printing.

The commonly owned Japanese Patent Application Laid-open No. 039,795/1996 proposes an ink-jet printing method, which uses a liquid making the dye insoluble and solves the respective drawbacks set forth above, and can realize a low-running cost with restricting consumption of the liquid making the dye insoluble, to provide superior water resistance for the image on the plain paper than that in prior art, to make it possible to obtain a high-density image, and to make it possible to obtain an image achieving high color development without causing bleeding between colors.

In addition to solving of the problem of the bleeding of inks, the foregoing system further realizes both a higher image quality and higher printing speed in a case where a color image is printed on plain paper by the ink-jet printing system.

More specifically, associated with the improvement and spreading of the computer environment and multi-media, is a demand for a higher quality of color image which is becoming progressively stronger and a demand for diversification of image information to be handled therein. Adapting for such demand, there has been practiced a printer which additionally employs color inks having lower dye concentration than that of the normal color ink to be used for color printing to enable the output of a color image of comparable quality to a silver film photograph.

For example, the method for printing of a color image employing six kinds of inks, in which additional cyan ink and magenta ink, respectively, having lower dye concentration than that of the normal cyan and magenta inks, are employed in addition to four kinds of inks of black ink, cyan ink, magenta ink and yellow ink to be used in normal color image printing, has been known.

However, in the foregoing method, while high image quality comparable with the silver film photograph can be realized, a problem can be encountered in that, for certain types of users who mainly output black image primarily consisting of characters, as are frequently output in an office environment or for users who mainly output business documents, in which color graphics are admixed in the black image, the printing heads for ejecting the inks of low dye concentration are wasted since they are rarely used.

SUMMARY OF THE INVENTION

It is an object of the present invention to provide an ink-jet printing apparatus and an ink-jet printing method which can print an image without causing bleeding between colors or feathering even when printing a color image on plain paper, while effectively using inks, and can realize high image quality comparable with a silver film photograph.

Another object of the present invention is to provide an ink-jet printing apparatus and an ink-jet printing method which can selectively perform in first and second printing modes, in which an image primarily consisting of black is printed in the first printing mode and a high quality image can be printed using high and low density inks in the second printing mode.

A further object of the present invention is to provide an ink-jet printing apparatus and an ink-jet printing method which can increase the density of a black image and can print a high quality image with reduced bleeding or feathering by using a printing-quality improving liquid in the first printing mode.

A still further object of the present invention is to provide an ink-jet printing apparatus and an ink-jet printing method, in which a head unit ejecting low-density cyan and magenta inks and black ink and a head unit ejecting the black ink and the printing quality improving liquid, are exchangeably used, and each head unit is formed into a structure having three ejecting portions so to as be of identical structure for convenience of manufacturing.

In a first aspect of the present invention, there is provided an ink-jet printing apparatus for performing printing by using a printing head to eject an ink to a printing medium, comprising:

first printing-mode executing means for performing printing by ejecting at least cyan, magenta, yellow and black inks from the printing head;

second printing mode executing means for performing printing by ejecting at least cyan, magenta, and yellow inks, and cyan and magenta inks respectively having lower densities than that of the cyan and magenta inks; and printing control means for making one of the first and second printing-mode executing means perform printing.

In a second aspect of the present invention, there is provided an ink-jet printing method for performing printing by using a printing head to eject an ink to a printing medium, comprising the steps of:

setting one of a first printing mode performing printing by ejecting at least cyan, magenta, yellow, and black inks from the printing head and a second printing mode performing printing by ejecting at least cyan, magenta, and yellow inks, and cyan and magenta inks having a lower density than that of the cyan and magenta inks from the printing head, as a printing mode; and performing printing in the printing mode set by the step for setting.

The above and other objects, effects, features and advantages of the present invention will become apparent from the following description of embodiments thereof taken in conjunction with the accompanying drawings.

DESCRIPTION OF THE PREFERRED EMBODIMENT

The preferred embodiments of the present invention will be described hereinafter in detail with reference to the drawings.

Embodiment 1

Figure 1A:
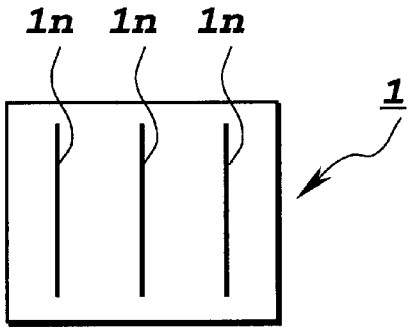
FIGS. 1A to 1C are diagrammatic illustrations showing the construction of the first embodiment of a printing head unit according to the present invention.
Figure 1B:
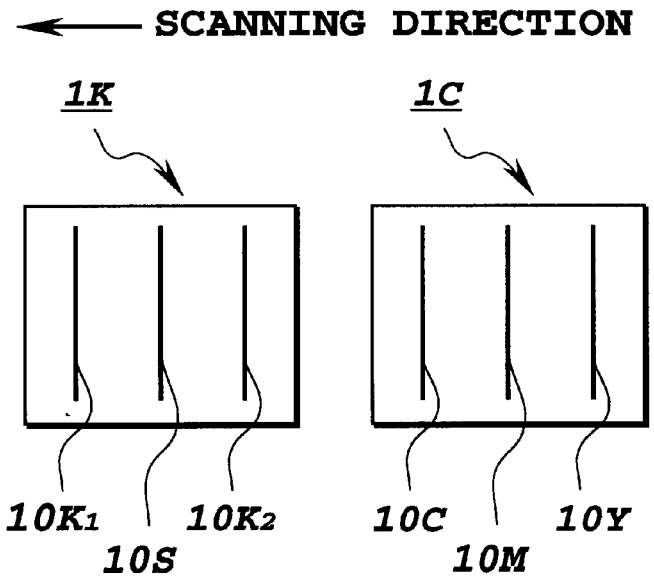
Figure 1C:
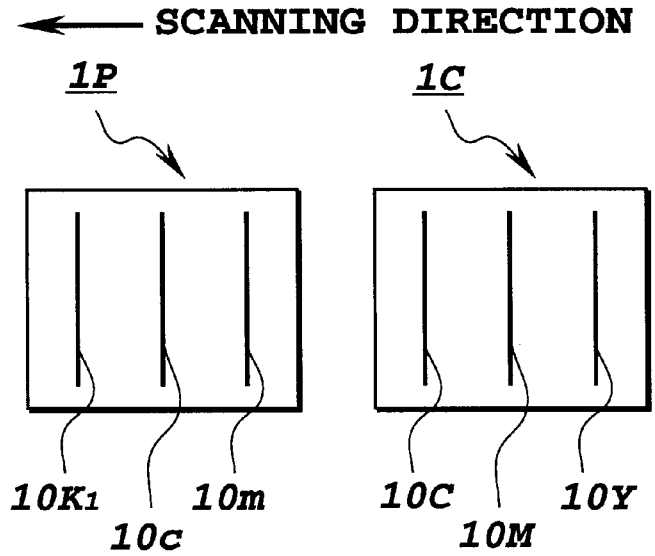

FIGS. 1A to 1C are illustrations for explaining the general construction of a printing head to be employed in one embodiment of the present invention, and diagrammatically showing an array of ink ejecting openings.

FIG. 1A shows the basic construction of a printing head unit 1 to be employed in the shown embodiment, in which ejecting portions 1*n* each consisting of a plurality of ink ejection openings are arranged in three rows. The printing head unit 1 has a predetermined number of ejection openings aligned in a predetermined density in each ejecting portion 1*n*. In ink passages provided corresponding to respective ejection openings, electro-thermal transducers generating thermal energy to be used for ejection are arranged. It should be noted that, in the drawings, each row of ejection openings are illustrated by a single straight line for simplification of illustration. Also, the printing head unit 1 has an ink-supply system per each ejecting portions in and particularly has a common liquid chamber, an ink supply tube and so on separately from each other. By this arrangement, different kind of inks can be ejected from respective ejecting portions.

In the shown embodiment, there are two modes as printing modes. In the respective modes, the printing heads having the basic construction as illustrated in FIG. 1A are used in combination depending upon the kinds of inks to be ejected in respective modes.

FIG. 1B is an illustration showing a combination of the printing head units to be used in a first printing mode among the two modes. As shown in FIG. 1B, in a printing head unit 1K, an ejecting portion 10S for ejecting a liquid for making inks to be used for printing, insoluble (S; hereinafter also referred to as "printing-quality improving liquid") is disposed between two ejection portions 10K1 and 10K2 both ejecting black ink (K). Further, in a printing head unit 1C, an ejecting portion 10C ejecting a cyan ink (C), an ejecting portion 10M ejecting a magenta ink (M) and an ejecting portion 10Y ejecting a yellow ink (Y) are arranged. It should be noted that the printing-quality improving liquid represents the liquid making a dye contained in the ink insoluble, and contributes for improvement of various images by making the dye insoluble as will be described later.

FIG. 1C shows a combination of the printing head units to be used in a second printing mode. As can be clear from FIG. 1C, the printing head unit 1C is used similarly to that in the first printing mode. On the other hand, also illustrated is a printing head unit 1P having an ejecting portion 10K1 ejecting the black ink, an ejecting portion 10*c* ejecting a cyan ink having lower dye concentration in comparison with the cyan ink to be ejected through the printing head unit 1C, and an ejecting portion 10*m* ejecting a magenta ink of lower dye concentration, similarly.

The foregoing printing head units 1K, 1C and 1P are adapted to be detachably mounted on a carriage which forms a scanning means. By this, each printing head unit can perform scanning in a direction substantially perpendicular to an arrangement direction of the ejection openings in the ejecting portion. During scan, the ink and/or the printing-quality improving liquid are ejected through respective ejection openings at a predetermined timing to form dots of respective inks.

In the shown embodiment, by selectively exchanging the printing head unit 1K and the printing head unit 1P, printing can be performed in the first printing mode using the units 1K and 1C and in the second printing mode using the units 1P and 1C. In this case, setting of the printing mode is performed in such a manner that a control portion of the apparatus distinguishes the loaded printing head unit between the units 1K and 1P, associating with loading of the printing head unit on the carriage, and sets the printing mode based thereon, as will be explained later.

As set forth above, by varying the printing head to be used in each printing mode, namely by changing the inks, at least K ink and respective Y, M, C inks can be used in the first printing mode. By this, printing adapted for the black image primarily consisting of characters or for business documents in which color graphics or the like are admixed with the black image, can be performed. In addition, in the shown embodiment, since the printing-quality improving liquid S is used for K ink, the water resistance and density of black image can be enhanced. Also, it becomes possible to perform high quality printing without causing bleeding between the colors at a boundary between a black printing region and a color printing region.

Furthermore, in the shown embodiment, two ejecting portions are provided for K ink and the arrangement of the ejecting portions for the printing-quality improving liquid S is set to be K, S, K as shown in FIG. 1B, and the order of ejection of the printing quality improving liquid S relative to K ink in both the forward path and the return path in bidirectional printing can be always constant. By this arrangement, the printed image quality in either direction in bidirectional printing, can be equal to each other. Also, even the if penetration ability of the printing-quality improving liquid is improved for improving fixing ability, when the inks are ejected in a sequential order of K, S, K, the amount of black ink to be reacted with the printing-quality improving liquid can be increased. As a result, the fixing ability of the image can be improved and a sharp black image can be obtained.

On the other hand, in the second printing mode, at least the C and M inks of low dye concentration and the C, M, and Y normal inks can be used. By this arrangement, a high quality image comparable with a silver film photograph, having an excellent gray scale, can be printed.

Furthermore, in the shown embodiment, the printing head unit 1K and the printing head unit 1P are used selectively by exchanging, corresponding to the first and the second printing modes, respectively. In each of the printing units, three ejecting portions are provided so that respective printing head units are identical in structure. By this, the manufacturing cost and so on of the printing head unit can be reduced significantly. Also, concerning the printing head unit 1C, which is not exchanged depending upon the printing mode, the structure can be common to those of the printing head units 1K and 1P to further lower manufacturing costs and so on. By making the structure of the printing head in common, namely, the structure of three ejecting portions per one unit, has been employed based on the inventor's following findings.

Concerning the black (K) ink, in view of the prevention of feathering or the increasing of density, it is possible to use an ink having a low penetration ability into the printing medium. In such case, by reaction of the black ink with the printing quality improving liquid, a dot of the K ink on the printing medium becomes relatively small to cause difficulty in obtaining increasing of density in the entire area. As a solution for this, twice as much K ink is ejected so that the area factor of the K ink dot effectively functions, and for this purpose, two K ink ejecting portions 10K1 and 10K2 are provided in one printing head unit 1K. As a result, either unit to be employed in the first and the second printing modes can be common in structure. By this arrangement, the foregoing various advantages can be obtained. In conjunction therewith, since the structure of loading of the unit can be made common, this contributes to simplification of the structure of the apparatus.

Figure 2A:
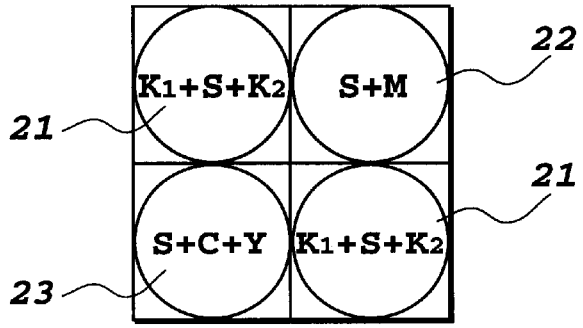
FIGS. 2A to 2D are diagrammatic illustrations of ink-jet printing for explaining a printing process in the first embodiment of the present invention.
Figure 2B:
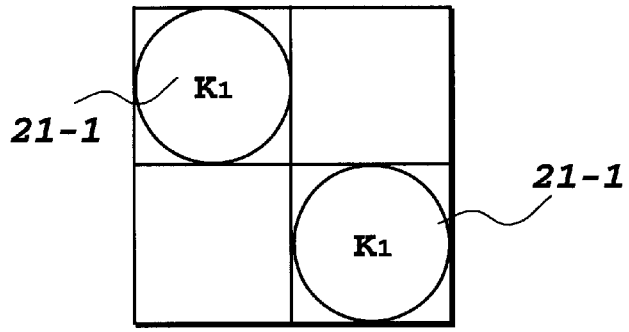
Figure 2C:
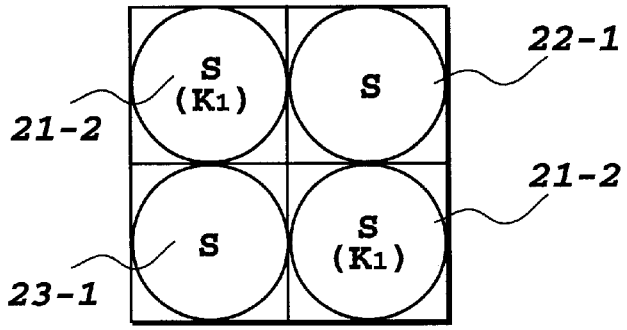
Figure 2D:
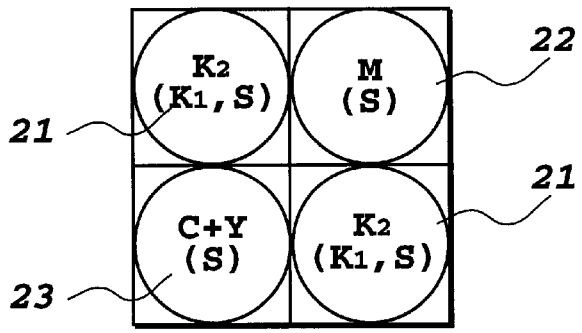

FIGS. 2A to 2D are illustrations of an example of printing explained by dot formation on the printing medium in the first printing mode. FIG. 2A shows a result of printing in 2×2 pixels, for example, in which black dots 21, magenta dots 22 and green (cyan+yellow) dots 23 are printed, and FIGS. 2B to 2D shows its processes.

In order to obtain the black dot 21 of FIG. 2A, with scanning by the carriage as set forth above, the black ink K1 is ejected from the ejecting portion 10K1 of the printing head unit 1K to form dots 21-1, as shown in FIG. 2B. It should be appreciated that these dots are formed by each ink droplet ejected from one ejection opening. Subsequently, as shown in FIG. 2C, for the same pixels, on which the black ink K1 is ejected, the printing quality improving liquid S is ejected through the ejecting portions 10S of the printing head 1K to form respective dots 21-2. Then, finally, as shown in FIG. 2D. The black ink K2 is ejected through the ejecting portions 10K2 of the printing head unit 1K to form the dots 21.

Also, in order to obtain the magenta dot 22 shown in FIG. 2A, at first, as shown in FIG. 2C, a dot 22-1 is formed by ejecting the printing quality improving liquid S through the ejecting portion 10S of the printing head unit 1K, Subsequently, as shown in FIG. 2D, to the same pixel, the magenta ink is ejected through the ejecting portion 10M of the printing head unit 1C to form the dot 22.

Furthermore, in order to obtain the green dot 23 shown in FIG. 2A, at first, as shown in FIG. 2C, dot 23-1 is formed by ejecting the printing-quality improving liquid S through the ejecting portion 10S of the printing head unit 1K, Subsequently, as shown in FIG. 2D, to the same pixel, the cyan ink is ejected through the ejecting portion 10C of the printing head unit 1C and the yellow ink is ejected through the ejecting portion 10Y of the printing head unit 1C to form the dot 23.

Through the foregoing process, printing using the color ink and the printing quality improving liquid in the first printing mode can be performed.

On the other hand, in the second printing mode using the printing head construction as shown in FIG. 1C, conventionally known printing using high and low density inks is performed. In this case, the dye concentrations of the cyan ink and the magenta ink to be ejected from ejecting portions 10*c* and 10*m* of the printing head unit 1P are lower than dye concentrations of the cyan ink and the magenta ink to be ejected from the ejecting portions 10C and 10M of the printing head unit 1C, as set froth above. By this arrangement, upon forming the color image, an image of the bright portion where density is low is mainly printed using the cyan and magenta inks of low dye concentration. Therefore, the granular feeling of the obtained image can be reduced to obtain an image quality comparable with a silver film photograph. It should be noted that, in printing using the high and low density inks, as conventionally known, a table defining density values of high density ink and low density ink, respectively, can be employed to define the respective density, depending upon the density value of the printing data, and then, ejection data for the high-density ink printing head and the low-density ink printing head are obtained by performing a binarizing process or the like on a basis of the density data obtained from the table.

In the foregoing explanation, the word "printing quality improving" means improvement of image quality to be determined by the factors of density, chroma, sharpness of edge portion, dot diameter and so on, improvement in fixing ability of the ink, improvement in resistance to climatic condition, such as water resistance, light fastness, namely shelf life of the image, and so on.

Further, "making insoluble" represents a phenomenon, in which an anionic radical contained in the dye of the ink and a cationic radical of a cationic substance contained in the printing quality improving liquid causes ionic interaction to cause ion coupling to cause separation of the coloring agent (dye) uniformly dissolved in the ink from the solution. It should be noted that, in the present invention, even when not all of the dye in the ink becomes insoluble, the effect in improvement of density, improvement of character quality, improvement of fixing ability can be obtained.

The word "coagulate" is used to mean "making insoluble" for the case where the coloring agent used in the ink is a water-base dye containing an anionic radical. On the other hand, when the coloring agent used in the ink is a pigment, the wording "coagulate" includes ionic interaction caused between a pigment dispersing agent or surface of the pigment and the cationic radical of the cationic substance, to cause breakdown of dispersion, to form giant particle of pigment. Normally, associated with foregoing coagulation, the viscosity of the ink is increased. It should be noted that, in the present invention, not all of the pigment or dispersion agent in the ink is made insoluble, and the effect in improvement of density, improvement of character quality, improvement of fixing ability as required in the present invention can be obtained.

Figure 3:
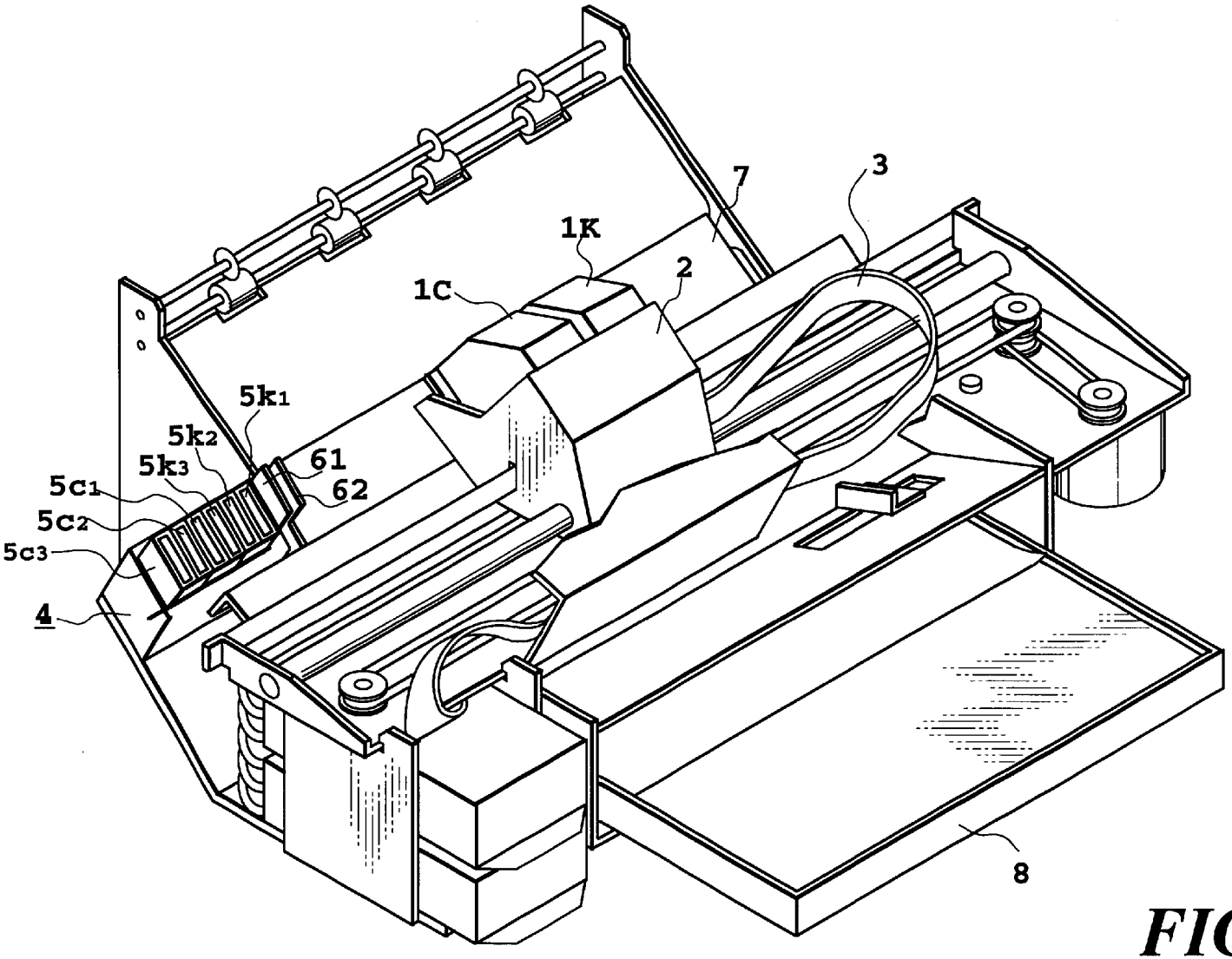
FIG. 3 is a perspective view showing the general construction of an ink-jet printer according to the first embodiment of the present invention.

FIG. 3 is a perspective view showing a general construction of an ink-jet printer as one example of an ink-jet printing apparatus, to which the present invention is applicable.

In the shown printer, the printing head unit shown in FIGS. 1B and 1C can be employed. More specifically, in the first printing mode forming a high quality image on plain paper at a high speed, the printing head units 1K and 1C shown in FIG. 1B are employed. On the other hand, in the second printing mode forming a high quality image comparable with a silver film photograph, the printing head units 1P and 1C shown in FIG. 1C are employed. Namely, a carriage 2 detachably mounts the printing head units 1K and 1C or the printing head units 1P and 1C. Depending upon the loaded printing head unit upon exchanging of the printing head units between the units 1K and 1P, the printing mode is automatically set. A flexible cable for feeding an electrical signal from a printer main body to the printing heads is provided to follow the motion of the carriage 2. In a motion path of the carriage 2, a recovery unit 4 having a recovery means is provided. A printing paper 7 as the printing medium is stored in a paper feeding tray 8 and fed to a lower side of a scanning region by the carriage 2 one by one. The recovery unit 4 has caps 5K1, 5K2, 5K3, 5C1, 5C2 and 5C3 corresponding to respective ejecting portions of the printing head units 1K, 1P and 1C, and blades 61 and 62 formed of a material, such as a rubber or the like. The blade 61 is adapted to wipe the ejecting portions 10K1 and 10K2 ejecting the black ink of the printing head unit 1K and the respective ejecting portions 10C, 10M and 10Y for cyan ink, magenta ink and yellow ink. On the other hand, the blade 62 is adapted to wipe the ejecting portion 10S ejecting the printing-quality improving liquid of the printing head unit 1K. Therefore, these blades are provided for movement forward and backward relating to the motion path of the carriage so that an ejection opening surface provided with the ejecting portion can be wiped when respective ejecting portions pass across associated with motion of the carriage 2.

The printer having such a construction performs printing of a width corresponding to the number of ejection openings by scanning the printing head units 1K or 1P, and 1C in a direction (primary scanning direction) perpendicular to the transporting direction of the printing medium, and performs paper feeding by an amount corresponding to a printing width during an interval between primary scans. By repeating these scan operations, printing is progressed.

Each of the ejecting portions of the printing head units 1K, 1P and 1C has 256 ejection openings in a density of 600 per 1 inch. From each ejection opening, about 17 ng of the printing-quality improving liquid or the ink is ejected. Accordingly, the printing density in the auxiliary scanning direction is 600 dpi (dot per inch), and associated therewith, ejection timing and so on are controlled so that printing is performed with the printing density in the primary scanning direction also being 600 dpi. In each ejecting portion of the printing head unit, the ink or the printing quality improving liquid is supplied from a tank (not shown) storing the ink or the printing quality improving liquid.

Figure 4:
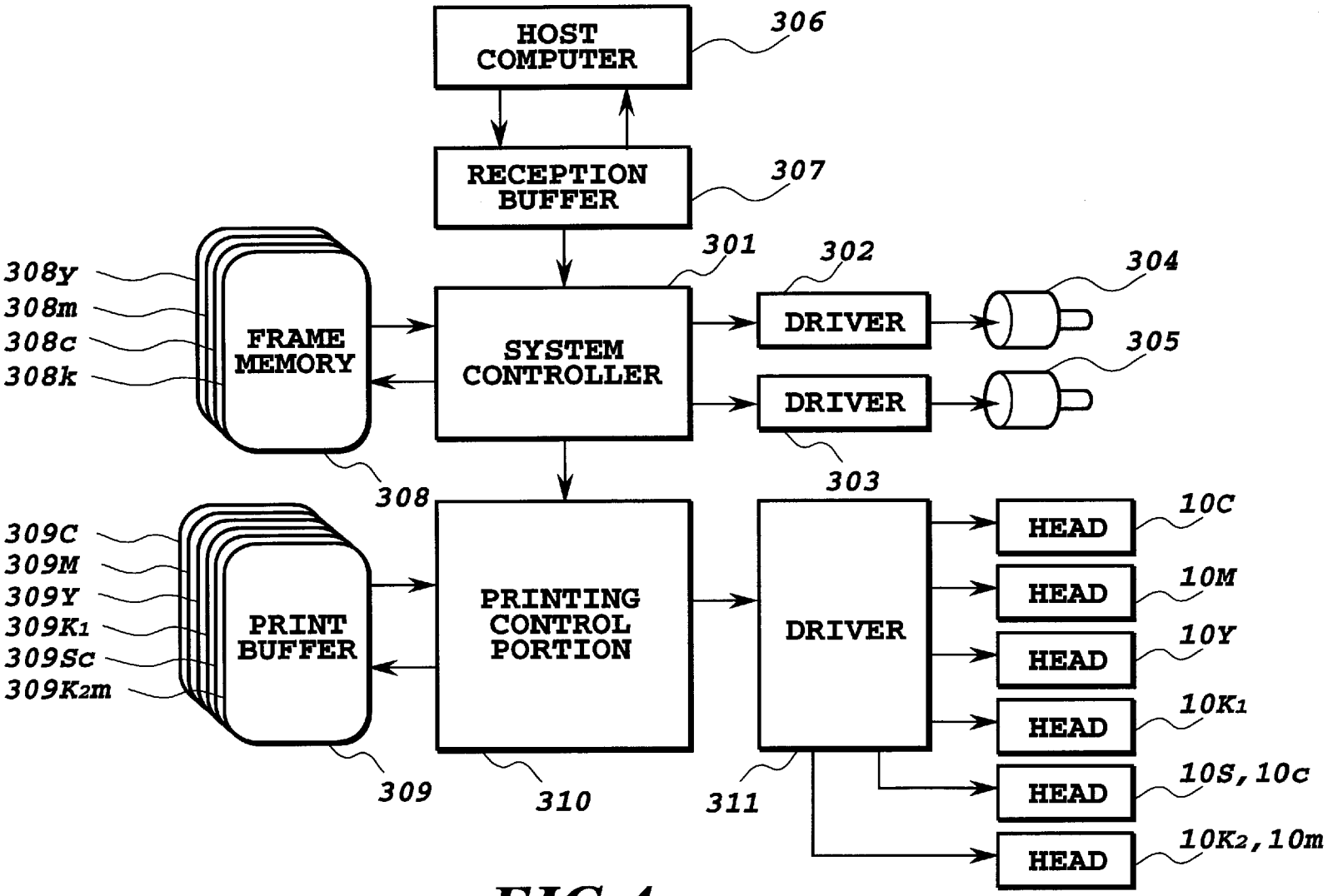
FIG. 4 is a block diagram showing the construction of a control system of the ink-jet printer.

FIG. 4 is a block diagram showing the construction of a control system of the foregoing ink-jet printer.

In FIG. 4, a reference numeral 301 denotes a system controller for controlling the overall apparatus, and includes a microprocessor, a storage element (ROM) storing a control program, and a storage element (RAM) to be used upon performing a process of the microprocessor. A reference numeral 302 denotes a driver for driving a carriage motor 304, and a reference numeral 303 denotes a driver for driving a paper feeder motor 305.

A reference numeral 306 denotes a host computer, and is an apparatus for feeding information or the like to be printed to the printer of the shown embodiment. A reference numeral 307 denotes a reception buffer for temporarily storing data from the host computer 306 to accumulate data until reading of data is performed by the system controller 301. A reference numeral 308 denotes a frame memory for developing data to be printed into an image data and has the storage capacity necessary for data of printing. In the shown embodiment, the frame memory has a storage capacity for data of one sheet of the printing paper. It should be noted that the present invention is not restricted to the specific size of the frame memory, as a matter of course.

A printing control portion 310 generates ejection data per respective ejecting portions on a basis of respective colors of image data stored in the frame memories 308*y*, 308*m*, 208*c* and 308*k*. More specifically, data for ink ejection and data for ejection of the printing-quality improving liquid are generated corresponding to respective ink ejecting portions. It should be noted that, in the shown embodiment, the ejection data of the printing quality improving liquid is generated on a one by one basis corresponding to the ejection data of black (K). However, as a matter of course, the ejection data of the printing-quality improving liquid is not specified in the shown example. In addition, the ejection data of the ejecting portions 10K1 and 10K2 are generated in a relationship of one by one with respect to the image data of black (K). By this arrangement, the K ink in an amount twice that of other color inks is ejected for the pixel. Further, the printing control portion 310 feeds the ejection data to the driver. 311 to control ejection of the ink or the printing quality improving liquid of each printing head unit. Corresponding to the generation of the ejection data by the printing control portion 310, the print buffer 309 has six storage regions 309C, 309M, 309Y, 309K1, 309Sc, and 309K2, for temporarily storing the ejection data.

In further detail, a control mode of the printing control portion 310 is varied depending upon the first or the second printing mode set by the system controller 301. In the first printing mode, the ejection data for the ejecting portion 10C, 10M, 10Y, 10K1, 10S and 10K2 are generated in the foregoing correspondence. On the other hand, in the second printing mode, for ejection data for the ejecting portions 10*c* and 10*m*, the ejection data is generated by image data processing using the known distribution table, as set forth above. It should be noted that, concerning the data for the low density ink, it may be possible that the image data is preliminarily generated in the host computer and such image data is transferred to the shown embodiment of the printer. In this case, the load on the printing control portion on the printer side can be reduced. However, in such case, it is desirable that the printing mode set in the printer can be recognized by the host computer.

A driver 311 drives electro-thermal transducers (not shown) corresponding to respective ejection openings of respective ejecting portions on the basis of the foregoing ejection data and the control data. By this arrangement, ejection of the ink or the printing-quality improving liquid can be performed.

Figure 5:
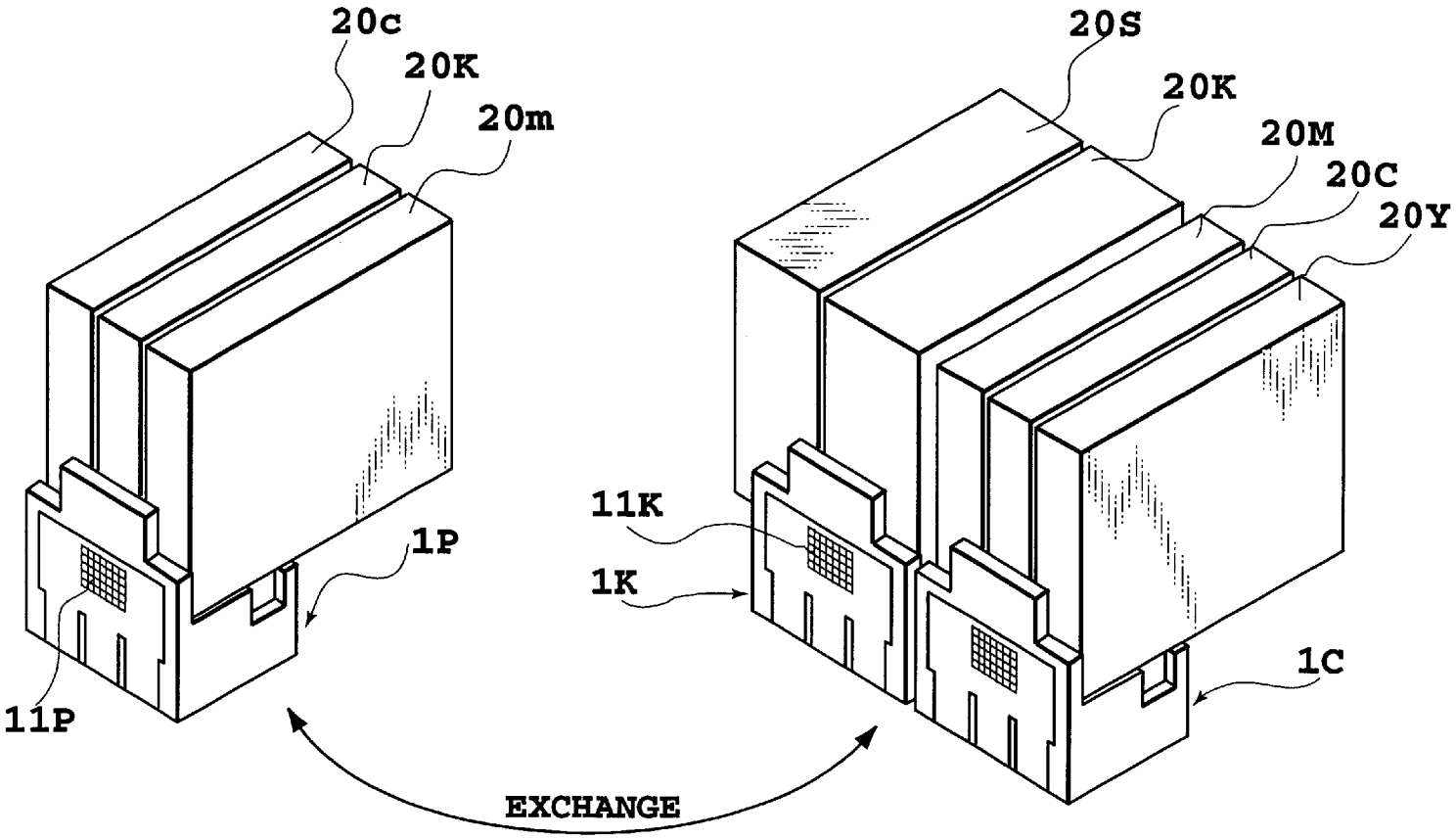
FIG. 5 is a perspective view showing a detail of a printing head unit and an ink tank to be employed in the first embodiment of the present invention.

FIG. 5 shows a detail of the shown embodiment of the printing head unit and the tank storing the ink and the printing quality improving liquid, and explains the setting of the printing mode associated with loading of the printing head unit.

As shown in FIG. 5, the distinction between the printing head unit 1K and the printing head unit 1P can be performed by reading a potential of an ID terminal formed on contact portions 11K and 11P provided respectively. More specifically, the ID terminal of the contact portion 11P of the printing head unit 1P is connected to the ground GND, and the ID terminal in the contact portion of the printing head unit 1K is not connected to the ground GND but is provided to have a predetermined potential. By this potential difference, the printing head units 1K and 1P can be distinguished from each other. Grounding/not grounding of the ID terminal can be made by preliminarily cutting a predetermined pattern upon manufacturing of the unit. By this, the system controller 301 (see FIG. 4) can set the first or second printing modes depending upon a kind of the printing head unit loaded.

It should be noted that the ejecting portions 10C, 10M and 10Y or so forth shown in FIGS. 1B and 1C are located to the lower surface of the respective printing head unit in FIG. 5. In addition, respective printing head units and the tanks 20*c*, 20K, 20*m*, 20S, 20C, 20M and 20Y are constructed for detaching with each other. Further, in each of the printing head units, ink supply paths from the respective tanks are formed so that the ink supply paths for two ejection portions at a moving side of the printing head unit in the scanning direction cross each other. More specifically, the tanks 20M, 20C, 20Y are mounted in this order as shown in FIG. 5, and then respective inks can be supplied to the respective ejection portions 10C, 10M, 10Y as shown in FIGS. 1B and 1C. With respect to the printing head unit 1K, the black ink can be supplied to both ejection portions 10K1 and 10K2 from only one black tank 20B by means of an arrangement of the ink supply path stated above. The printing head unit 1P has a similar arrangement of the ink supply path to that in the printing head unit 1C.

It should be noted that the setting of the printing modes is not limited to the foregoing construction. For example, setting of the printing mode becomes possible for setting any one of the printing modes by the user of a printer by means of a changeover switch of the printing-head unit provided on the printer, a command from the host computer and so on. Also, it may be possible to generate the ejection data to be used in respective first and second printing modes in the host computer corresponding to the selection of the printing mode and to the transfer to the printer.

Further, in the shown embodiment, the following ink and the printing-quality improving liquid are used. The dilution rate of the cyan ink and the magenta ink of lower density was four times that of the normal ink. In addition, "acetylenol EH" in the following composition is a trade name and is a product by Kawa Ken Fine Chemical. Its name as a chemical substance is ethylene oxide-2,4,7,9-tetramethyl-5-decyne-4, 7-diol.

| (Ink) | |
|---|---|
| 1. Yellow (ejecting portion 10Y) | |
| glycerin | 7.5 parts by weight |
| tiodiglycol | 7.5 parts by weight |
| urea | 7.5 parts by weight |
| isopropyl alcohol | 4.0 parts by weight |
| acetylenol EH | 0.1 parts by weight |
| triethanol amine | 0.47 parts by weight |
| 4N-lithium hydroxide | 1.88 parts by weight |
| ammonium sulfate | 0.25 parts by weight |
| Projet Fast Yellow 2 | 1.5 parts by weight |
| water | 69.03 parts by weight |
| 2. Magenta (ejecting portion 10M) | |
| glyceline | 7.5 parts by weight |
| tiodiglycol | 7.5 parts by weight |
| urea | 7.5 parts by weight |
| isopropyl alcohol | 4.0 parts by weight |
| acetylenol EH | 0.1 parts by weight |
| 10%-LiOAc | 1.84 parts by weight |
| triethanol amine | 0.86 parts by weight |
| Projet Fast Magenta 2 | 2.5 parts by weight |
| water | 67.2 parts by weight |
| 3. Cyan (ejecting portion 10C) | |
| glyceline | 7.5 parts by weight |
| tiodiglycol | 7.5 parts by weight |
| urea | 7.5 parts by weight |
| iropropyl alcohol | 4.0 parts by weight |
| acetylenol EH | 0.1 parts by weight |
| Direct Blue 199 | 2.5 parts by weight |
| water | 70.9 parts by weight |
| 4. Black (ejecting portions 10K1 and 10K2) | |
| glyceline | 7.5 parts by weight |
| tiodiglycol | 7.5 parts by weight |
| urea | 7.5 parts by weight |
| isopropyl alcohol | 4.0 parts by weight |
| ammonium sulfate | 0.45 parts by weight |
| NaOH | 0.36 parts by weight |
| C.I. Direct Black 154 | 3.5 parts by weight |
| water | 69.19 parts by weight |
| 5. Low Density Magenta (ejecting portion 10m) | |
| glyceline | 7.5 parts by weight |
| tiodiglycol | 7.5 parts by weight |
| urea | 7.5 parts by weight |
| isopropyl alcohol | 4.0 parts by weight |
| acetylenol EH | 0.1 parts by weight |
| 10%-LiOAc | 0.31 parts by weight |
| triethanol amine | 0.14 parts by weight |
| Projet Fast Magenta 2 | 0.56 parts by weight |
| water | 72.39 parts by weight |
| 6. Low Density Cyan (ejecting portion 10c) | |
| glyceline | 7.5 parts by weight |
| tiodiglycol | 7.5 parts by weight |
| urea | 7.5 parts by weight |
| isopropyl alcohol | 4.0 parts by weight |
| acetylenol EH | 0.1 parts by weight |
| Direct Blue 199 | 0.63 parts by weight |
| water | 72.77 parts by weight |
| (Printing Quality Improving Liquid) | |
| glyceline | 7.5 parts by weight |
| diethylene glycol | 5.0 parts by weight |
| polyallyl amine | 3.6 parts by weight |
| isopropyl alcohol | 4.0 parts by weight |
| acetic acid | 0.35 parts by weight |
| benzalkonium chloride | 0.98 parts by weight |
| triethylene glycol monobutylether | 0.95 parts by weight |
| water | 82.12 parts by weight |

In the shown embodiment, the image obtained on plain paper in the first printing mode using the printing head unit 1K, is a sharp image having high density and lesser feathering. Furthermore, sufficient water resistance of the image can be confirmed. In addition, upon printing of only black image, or when a part of the black image portion is the color image, the black image portion can be printed in both of forward and reverse scan to achieve high speed printing.

Furthermore, in case of the second printing mode using the printing head unit 1P, for the problem of a granular feeling of the image in the highlight portion, which causes significant degradation of the image quality as in the prior art, the ink having a lower dye concentration is used in combination with the normal color ink to reduce the granular feeling in the highlight portion. Thus, a high quality color image comparable with the silver film photograph can be obtained.

Then, since the printing head unit 1K and the printing head unit 1P are exchangeable, the foregoing advantages can be achieved without causing an increase in the size and the cost of the printer.

Embodiment 2

Figure 6:
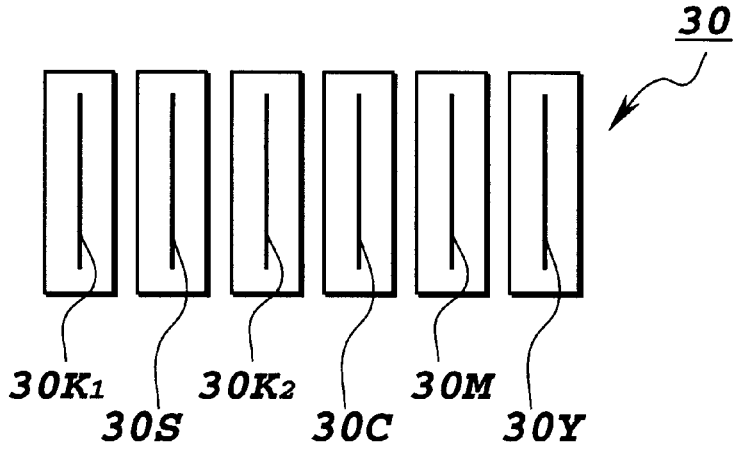
FIG. 6 is a diagrammatic illustration showing a printing head unit to be employed in a second embodiment of the present invention.

FIG. 6 shows a printing head having a construction different from the first embodiment of the printing head unit. In the shown embodiment, ejecting portions ejecting respective inks and the printing-quality improving liquid are arranged as respective independent printing heads. These printing heads are also supplied the ink or the printing-quality improving liquid from the tank (not shown). In this case, in comparison with the first embodiment, since the head can be exchanged independently, the running cost can be lowered. However, since it requires matching registration of respective colors, the adjusting mechanism becomes complicated to result in an increase in the cost or the user is required to perform extra operation.

Embodiment 3

In the foregoing first and second embodiments, an explanation has been given for the system, in which the printing units or heads are exchanged. In a construction where different ink or printing-quality improving liquids are used for one printing head, only tanks may be exchanged instead of exchanging the printing unit or head.

In this case, when the printing-quality improving liquid and the ink are exchanged for one printing head, coagulation can be caused by contacting of the formerly used printing-quality improving liquid or the ink and the currently used ink or the printing-quality improving liquid to possibly cause plugging or sticking in various portions in the printing head. Therefore, it becomes necessary to prevent coagulation of the coloring agent. As a preventing means, washing means of the printing head may be provided separately.

For example, when the tank of the printing-quality improving liquid is exchanged with the tank for the cyan ink having a lower dye concentration, or the vice versa, a tank preliminarily containing a washing liquid is loaded to the corresponding ejecting portion to perform a recovery process, such as suction, and thereafter exchanging of the tank is performed. It should be noted that upon exchanging between different colors of inks, since coagulation may not be caused, a recovery process, such as suction, after exchanging, may be sufficient.

Figure 7:
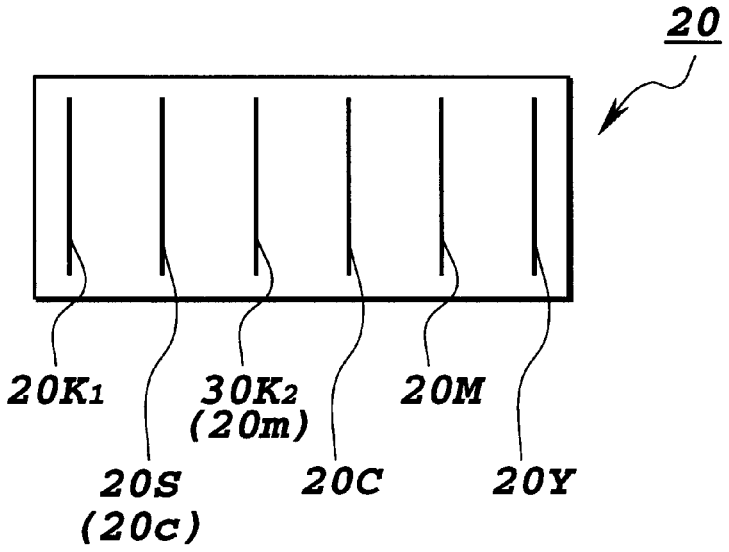
FIG. 7 a diagrammatic illustration showing a printing head unit to be employed in a third embodiment of the present invention.

The printing head employed in the shown embodiment is not the printing head unit, in which the three ejecting portions are integrated as the first embodiment, but can be the printing head unit, in which six ejecting portions are integrated as shown in FIG. 7. In the alternative, it can be freely combined, such as one ejecting portion and fixed ejecting portions.

In the shown embodiment, since it is only required for exchanging of the tanks instead of exchanging of the printing head, the number of necessary printing heads becomes smaller. However, a problem is encountered as a washing tank is required separately.

Other Embodiment

While a construction, in which the tanks are independently exchangeable in the shown embodiment, it is possible to be independent for each color or only tanks of the color inks are integrated.

Also, it is possible to employ a printing head unit, in which the tank and the ejecting portion are integrated.

Furthermore, the construction of the ejecting portion of the printing head unit of the first embodiment, as shown in FIG. 1B is that the ejecting portion 10S, ejecting the printing-quality improving liquid, is disposed between the ejecting portions 10K1 and 10K2 ejecting the black ink. However, the construction is not specified to this embodiment, but can be the construction as illustrated in FIGS. 8A and 8B.

Figure 8A:
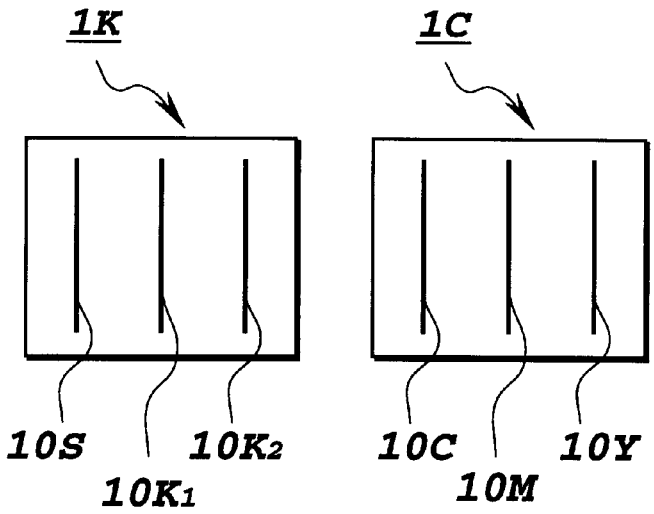
FIGS. 8A and 8B are diagrammatic illustrations showing printing head units to be employed in further embodiment of the present invention.

FIG. 8A shows the case where the printing-quality improving liquid is applied in advance of the application of the ink or where the printing-quality improving liquid is applied after application of the ink. One path printing is primarily taken for both of the black image and the color image.

Figure 8B:
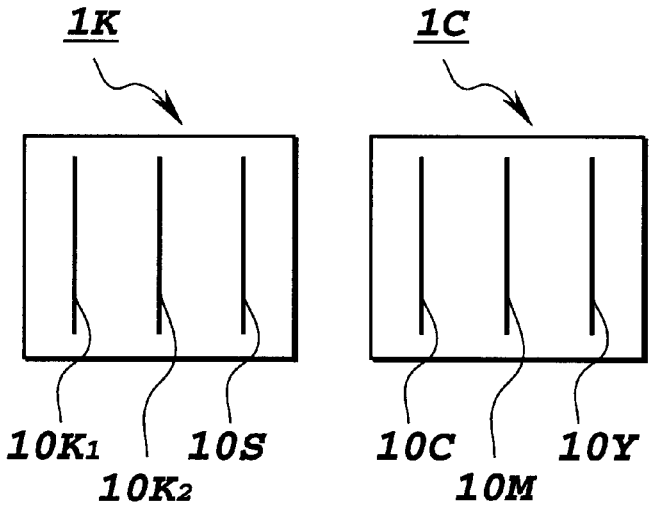

On the other hand, FIG. 8B shows a construction for bidirectional printing, in which formation of the black image and the color image corresponds to one of a forward scan or a reverse scan.

Which of the head constructions of FIGS. 1B, 8A and 8B is to be selected may be arbitrarily set in relation to the property of the ink and the printing quality improving liquid, and the speed of the carriage mounting the printing head.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion-based high molecular weight material P-1 (aqueous solution containing a solid ingredient of styrene methacrylic acid ethylacrylate of 20% having an acid value of 400 and average molecular weight of 6000, neutralizing agent: potassium hydroxide) as a dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts by weight |
| carbon black Mogul L (tradename: manufactured by Cablack Co.) | 24 parts by weight |
| glycerin | 15 parts by weight |
| ethylene glycol monobutyl ether | 0.5 parts by weight |
| isopropyl alcohol | 3 parts by weight |
| water | 135 parts by weight |

Next, the thus obtained dispersing element is sufficiently dispersed in water, and black ink K2 containing pigment for ink jet printing is obtained. The final product has a solid ingredient of about 10%

[Yellow ink Y2]

Anionic high molecular P-2 (aqueous solution containing a solid ingredient of 20% of stylenacrlylic acid methyl methaacrylate having an acid value of 280 and an average molecular weight of 11,000, neutralizing agent:diethanolamine) is used as a dispersing agent and dispersive treatment is conducted in the same manner as the production of the black ink K2 whereby yellow color dispersing element having a weight-average grain size of 103 nm is produced.

| (composition of yellow dispersing element) | |
|---|---|
| P-2 aqueous solution (having a solid ingredient of 20%) | 35 parts by weight |
| C. I. pigment yellow 180 (tradename : Nobapalm yellow PH-G, manufactured by Hoechst Aktiengesellschaft) | 24 parts by weight |
| triethylen glycol | 10 parts by weight |
| diethylenglycol | 10 parts by weight |
| ethylene glycol monobutylether | 1.0 parts by weight |
| isopropyl alcohol | 0.5 parts by weight |
| water | 135 parts by weight |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as a dispersing agent, and moreover, using the following materials by conducting a dispersing treatment in the same manner as the carbon black dispersing element.

| (composition of cyan colored-dispersing element) | |
|---|---|
| P-1 aqueous solution (having solid ingredient of 20%) | 30 parts by weight |
| C. I. pigment blue 153 (tradename : Fastogen blue FGF, manufactured by Dainippon Ink And Chemicals, Inc.) | 24 parts by weight |
| glycerin | 15 parts by weight |
| diethylenglycol monobutylether | 0.5 parts by weight |
| isopropyl alcohol | 3 parts by weight |
| water | 135 parts by weight |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as a dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts by weight |
| C. I. pigment red 122 (manufactured by Dainippon Ink And Chemicals, Inc.) | 24 parts by weight |
| glycerin | 15 parts by weight |
| isopropyl alcohol | 3 parts by weight |
| water | 135 parts by weight |

Magenta ink M2 for ink jet printing and having pigment contained therein is obtained by sufficiently dispersing the magenta colored dispersing element in water. The final product of ink has a solid ingredient of about 9.2%.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to an on-demand type or a continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from a solid to a liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, according to respective embodiments of the present invention, the first and second printing modes can be performed selectively. In the first printing mode, the image primarily in black can be printed. Further, in the second printing mode, high quality image can be printed using high and low density inks in the second printing mode.

In addition, when printing-quality improving liquid can be used in the first printing mode, it becomes possible to increase density of the image or to perform printing the high quality image having lesser bleeding or feathering.

Furthermore, by using the head unit ejecting the low density cyan and magenta inks and black ink and the head unit ejecting the black ink and the printing-quality improving liquid exchangeably, and the each unit is constructed with three ejecting portions, the same constructions can be used in common for the head units for facilitating manufacturing.

As a result, depending upon the use condition of the user, ink can be used effectively to obtain the ink-jet printing apparatus convenient to be used.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for performing printing on a printing medium by selectively using at least cyan ink having a first coloring-material density, magenta ink having a first coloring-material density, cyan ink having a second coloring-material density lower than that of the cyan ink having the first coloring-material density, and magenta ink having a second coloring-material density lower than that of the magenta ink having the first coloring-material density, said apparatus comprising:

first printing mode executing means for performing printing by using at least the cyan ink having the first coloring-material density and the magenta ink having the first coloring-material density without using the cyan ink having the second coloring-material density and the magenta ink having the second coloring-material density;

second printing mode executing means for performing printing by using at least the cyan ink having the first coloring-material density, the magenta ink having the first coloring-material density, the cyan ink having the second coloring-material density and the magenta ink having the second coloring-material density; and a mounting section for selectively mounting a plurality of ink tanks for the cyan ink having the first coloring-material density, the magenta ink having the first coloring-material density, the cyan ink having the second coloring-material density and the magenta ink having the second coloring-material density, wherein when said first printing mode executing means performs printing, at least the ink tanks for the cyan ink having the first coloring-material density and the magenta ink having the first coloring-material density are mounted on said mounting section and the ink tanks for the cyan ink having the second coloring-material density and the magenta ink having the second coloring-material density are not mounted on said mounting section, and when said second printing mode executing means performs printing, at least the ink tanks for the cyan ink having the first coloring-material density, the magenta ink having the first coloring-material density, the cyan ink having the second coloring-material density and the magenta ink having the second coloring-material density are mounted on said mounting section.

2. An ink-jet printing apparatus as claimed in claim 1, wherein said first printing mode executing means performs printing by further using a liquid for making a coloring agent in the ink insoluble or coagulated, and said second printing mode executing means performs printing by further using a black ink.

3. An ink-jet printing apparatus as claimed in claim 2, further comprising a printing head including a head unit having ejecting portions ejecting the respective first coloring-material density cyan ink and the first coloring-material density magenta ink, a head unit having an ejecting portion ejecting the liquid and two ejecting portions arranged on both sides of said ejecting portion ejecting the liquid, and a head unit having ejecting portions ejecting the second coloring-material density cyan and magenta inks and an ejecting portion ejecting the black ink.

4. An ink-jet printing apparatus as claimed in claim 3, further comprising a carriage including said mounting section for detachably loading each of the head units and scanning means for scanning the head unit for printing by shifting said carriage.

5. An ink-jet printing apparatus as claimed in claim 4, further comprising mode setting means for detecting a kind of the head unit loaded on said carriage and selecting said first or second printing mode executing means depending upon the kind of the head unit detected.

6. An ink-jet printing apparatus as claimed in claim 1, further comprising a printing head including a thermal energy generating element for generating thermal energy used for ejecting the inks or a processing liquid.

7. An ink-jet printing apparatus as claimed in claim 2, wherein said liquid includes a cationic substance comprising a first component and a second component having a higher molecular weight than said first component, and wherein a dye as a coloring agent contained in said ink is an anionic substance.

8. An ink-jet printing apparatus as claimed in claim 2, wherein said liquid includes a cationic substance comprising a first component and a second component having a higher molecular weight than said first component, and wherein said ink contains an anionic dye or at least an anionic compound and a pigment as a coloring agent.

9. An ink-jet printing method of performing printing on a printing medium by selectively using at least cyan ink having a first coloring-material density, magenta ink having a first coloring-material density, cyan ink having a second coloring-material density lower than that of the cyan ink having the first coloring-material density, and magenta ink having a second coloring-material density lower than that of the magenta ink having the first coloring-material density, said method comprising the steps of:

setting one of a first printing mode for performing printing by using at least the cyan ink having the first coloring-material density and the magenta ink having the first coloring-material density without using the cyan ink having the second coloring-material density and the magenta ink having the second coloring-material density and a second printing mode for performing printing by using at least the cyan ink having the first coloring-material density, the magenta ink having the first coloring-material density, the cyan ink having the second coloring-material density and the magenta ink having the second coloring-material density; and providing a mounting section for selectively mounting a plurality of ink tanks for the cyan ink having the first coloring-material density, the magenta ink having the first coloring-material density, the cyan ink having the second coloring-material density and the magenta ink having the second coloring-material density, wherein when the first printing mode is executed, at least the ink tanks for the cyan ink having the first coloring-material density and the magenta ink having the first coloring-material density are mounted on the mounting section and the ink tanks for the cyan ink having the second coloring-material density and the magenta ink having the second coloring-material density are not mounted on the mounting section, and when the second printing mode is executed, at least the ink tanks for the cyan ink having the first coloring-material density, the magenta ink having the first coloring-material density, the cyan ink having the second coloring-material density and the magenta ink having the second coloring-material density are mounted on the mounting section.

10. An ink-jet printing method as claimed in claim 9, wherein in the first printing mode, a liquid for making a coloring agent in the ink insoluble or coagulated is further used, and in the second printing mode, a black ink is further used.

11. An ink-jet printing method as claimed in claim 10, further comprising the step of providing a printing head including a head unit having ejecting portions ejecting the respective first coloring-material density cyan ink and the first coloring-material density magenta ink a head unit having an ejecting portion ejecting the liquid and two ejecting portions arranged on both sides of the ejecting portion ejecting the liquid, and a head unit having ejecting portions ejecting the second coloring-material density cyan and magenta inks and an ejecting portion ejecting the black ink.

12. An ink-jet printing method as claimed in claim 11, further comprising performing printing by scanning of the head unit loaded on a carriage having the mounting section for detachably loading each of the head units by shifting said carriage.

13. An ink-jet printing method as claimed in claim 12, wherein said step of setting the printing mode detects a kind of the head unit loaded on the carriage and sets the first or second printing mode depending upon the kind of the head unit detected.

14. An ink-jet printing method as claimed in claim 9, further comprising the step of providing a printing head including a thermal energy generating element for generating thermal energy used for ejecting the inks or a processing liquid.

15. An ink-jet printing method as claimed in claim 10, wherein said liquid includes a cationic substance comprising a first component and a second component having a higher molecular weight than said first component, and wherein a dye as a coloring agent contained in said ink is an anionic substance.

16. An ink-jet printing method as claimed in claim 10, wherein said liquid includes a cationic substance comprising a first component and a second component having a higher molecular weight than said first component, and wherein said ink contains an anionic dye or at least an anionic compound and a pigment as a coloring agent.

* * * * *

UNITED STATES PATENT AND TRADEMARK OFFICE

CERTIFICATE OF CORRECTION

PATENT NO. : 6,299,285 B1
DATED : October 9, 2001
INVENTOR(S) : Inui

It is certified that error appears in the above-identified patent and that said Letters Patent is hereby corrected as shown below:

Column 4,
Line 46, "so to as" should read -- so as to --.

Column 5,
Line 35, "FIG. 7" should read -- FIG. 7 is --.
Line 66, "portions in" should read -- portion 1*n* --.

Column 6,
Line 2, "kind" should read -- kinds --.
Line 61, "of" should read -- of a --.

Column 7,
Line 8, "the if" should read -- if the --.
Line 33, "inventor's following" should read -- following inventor's --.
Line 57, "shows its" should read -- show the --.

Column 9,
Line 2, "wording" should read -- word --.

Column 13,
Line 27, "supplied" should read -- supplied with --.
Line 34, "extra" should read -- an extra --.

Column 14,
Line 9, "Embodiment" should read -- Embodiments --.

UNITED STATES PATENT AND TRADEMARK OFFICE

CERTIFICATE OF CORRECTION

PATENT NO. : 6,299,285 B1
DATED : October 9, 2001
INVENTOR(S) : Inui

It is certified that error appears in the above-identified patent and that said Letters Patent is hereby corrected as shown below:

Column 16,
Line 60, "to" should read -- in --.

Column 18,
Line 14, "the" should be deleted.

Column 20,
Line 31, "ink" should read -- ink, --.

Signed and Sealed this

Twelfth Day of March, 2002

*Attest:*

*Attesting Officer*

JAMES E. ROGAN
*Director of the United States Patent and Trademark Office*